US010777932B2

(12) United States Patent
Mechteridis et al.

(10) Patent No.: US 10,777,932 B2
(45) Date of Patent: Sep. 15, 2020

(54) ELECTRIC PLUG WITH ELASTIC PRESS-ON ELEMENTS

(71) Applicant: TE Connectivity Germany GmbH, Bensheim (DE)

(72) Inventors: Dimitrios Mechteridis, Oftersheim (DE); Rudolf Pamin, Aschaffenburg (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/297,018

(22) Filed: Mar. 8, 2019

(65) Prior Publication Data

US 2019/0280418 A1 Sep. 12, 2019

(30) Foreign Application Priority Data

Mar. 9, 2018 (DE) ..... 10 2018 203 628

(51) Int. Cl.

| | |
|---|---|
| ***H01R 13/50*** | (2006.01) |
| ***H01R 13/506*** | (2006.01) |
| ***H01R 13/504*** | (2006.01) |
| ***H01R 13/516*** | (2006.01) |
| *H01R 13/502* | (2006.01) |
| *H01R 13/52* | (2006.01) |

(52) U.S. Cl.

CPC ..... *H01R 13/506* (2013.01); *H01R 13/5045* (2013.01); *H01R 13/516* (2013.01); *H01R 13/5025* (2013.01); *H01R 13/5202* (2013.01); *H01R 2201/26* (2013.01)

(58) Field of Classification Search

CPC ..... H01R 13/506; H01R 13/5045; H01R 13/516; H01R 13/5025

USPC ..... 439/701

See application file for complete search history.

(56) References Cited

U.S. PATENT DOCUMENTS 4,997,386 A * 3/1991 Kawachi ..... H01R 13/514 439/352
5,362,261 A * 11/1994 Puerner ..... H01R 13/4364 439/689
5,376,014 A * 12/1994 Sumida ..... H01R 13/6273 439/310
5,876,231 A * 3/1999 Pacher ..... H01R 13/6273 439/354
6,027,360 A * 2/2000 Jenkins ..... H01R 13/6215 439/248

(Continued)

FOREIGN PATENT DOCUMENTS

| | | |
|---|---|---|
| DE | 19530505 A1 | 2/1997 |
| DE | 19647021 A1 | 5/1998 |
| DE | 19919598 C2 | 5/2002 |

OTHER PUBLICATIONS

German Office Action, dated Dec. 7, 2018, 6 pages.
Abstract of DE19647021, dated May 20, 1998, 1 page.
Abstract of DE19530505, dated Feb. 20, 1997, 1 page.

*Primary Examiner* — Alexander Gilman
(74) *Attorney, Agent, or Firm* — Barley Synder

(57) ABSTRACT

An electric plug comprises an outer housing, an inner housing adapted to be plugged into the outer housing along an assembly direction, and a press-on element. The press-on element is adapted to be deflected elastically transversely to the assembly direction and produces a press-fit connection between the inner housing and the outer housing.

18 Claims, 3 Drawing Sheets

(56) References Cited

U.S. PATENT DOCUMENTS

| | | | | |
|---|---|---|---|---|
| 6,095,852 | A * | 8/2000 | Gregory, II | H01R 13/506<br>439/466 |
| 6,332,784 | B1 * | 12/2001 | Oliphant | H01R 31/065<br>361/679.4 |
| 6,793,400 | B2 * | 9/2004 | Massey | G02B 6/3879<br>385/53 |
| 7,118,414 | B2 * | 10/2006 | Spears | G06F 1/182<br>439/540.1 |
| 7,867,040 | B2 * | 1/2011 | Yu | H01R 13/518<br>439/701 |
| 8,430,692 | B2 * | 4/2013 | Peng | H01R 13/518<br>439/607.46 |
| 9,039,458 | B2 * | 5/2015 | Tsuchiya | H01R 24/20<br>439/686 |
| 9,300,087 | B2 * | 3/2016 | Smith | H01R 13/6395 |
| 9,379,473 | B2 * | 6/2016 | Okamoto | H01R 13/518 |
| 9,853,391 | B2 * | 12/2017 | Spencer | H01R 13/514 |
| 10,044,142 | B1 * | 8/2018 | Leon | H01R 13/6392 |
| 2008/0102683 | A1 * | 5/2008 | Menez | H01R 13/5219<br>439/345 |

* cited by examiner

ELECTRIC PLUG WITH ELASTIC PRESS-ON ELEMENTS

CROSS-REFERENCE TO RELATED APPLICATION

This application claims the benefit of the filing date under 35 U.S.C. § 119(a)-(d) of German Patent Application No. 102018203628.4, filed on Mar. 9, 2018.

FIELD OF THE INVENTION

The present invention relates to an electric plug and, more particularly, to an electric plug having an outer housing and an inner housing which can be plugged into the outer housing along an assembly direction.

BACKGROUND

Electric plugs having an inner housing which can be plugged into an outer housing are frequently provided with large tolerances, yet are intended to be free of play. Plugs of this type are frequently used, for example, as a chamber block inserted into a receptacle housing, in particular in the motor vehicle industry. The tolerance can lead to overpressing during mounting, as a result of which high plugging forces arise and it becomes more difficult to remove the inner housing during maintenance. Play can also occur between the inner and outer housing, as a result of which the service life of the electric plug is shortened due to vibrations and movements of the inner housing relative to the outer housing. Furthermore, the contacts of a mating plug can be lost or damaged as a result of the vibrations.

SUMMARY

An electric plug comprises an outer housing, an inner housing adapted to be plugged into the outer housing along an assembly direction, and a press-on element. The press-on element is adapted to be deflected elastically transversely to the assembly direction and produces a press-fit connection between the inner housing and the outer housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
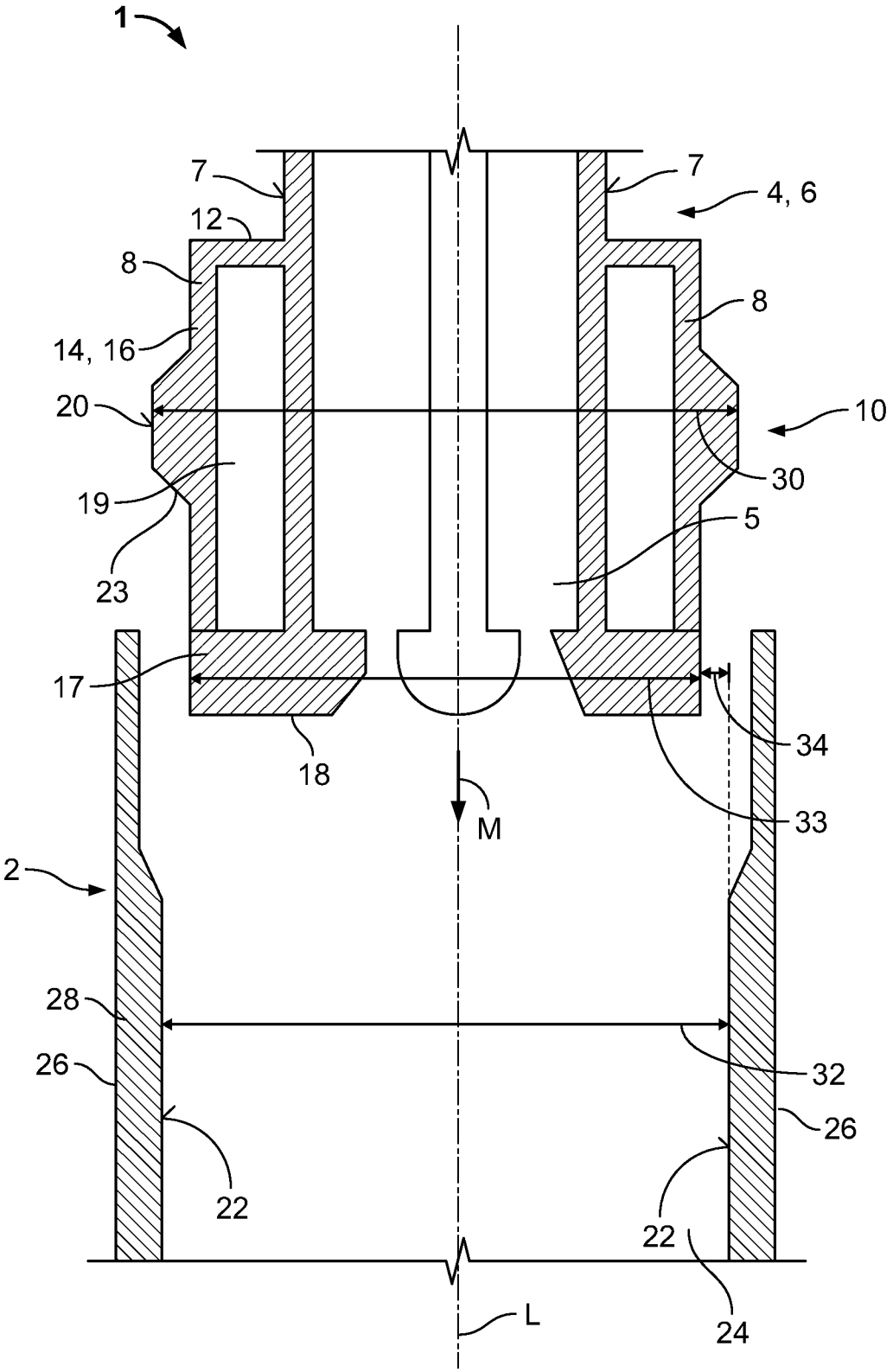
FIG. 1 is a sectional side view of an electric plug before mounting.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will convey the concept of the invention to those skilled in the art.

An electric plug 1 according to an embodiment shown in FIG. 1 has an inner housing 4 which can be plugged into an outer housing 2 along an assembly direction M.

The inner housing 4 can be, for example, a plug strip or a chamber block, which can be connected to a complementary plug. As shown in FIG. 1, the inner housing 4 is punctuated by a plurality of contact receptacles 5 along a longitudinal axis L. The inner housing 4 has an elongated base body 6, which extends along the longitudinal axis L arranged substantially parallel to the assembly direction M. The elongated base body 6 is bounded by four lateral surfaces 7, shown in FIG. 5, in a direction transverse to the assembly direction M. Two adjacent lateral surfaces 7 are arranged at substantially 90° to one another and, as a result, the base body 6 has a substantially rectangular cross-section transverse to the assembly direction M.

As shown in FIG. 1, a plurality of press-on elements 8 are overmolded on the lateral surfaces 7. The inner housing 4 and the press-on elements 8 are formed integrally as a monolithic component 10 and can be molded from a plastic, for example, by injection molding. In other embodiments, the electric plug 1 can be manufactured by 3D printing or dipping. In another embodiment, the press-on element 8 is a separate component, such as a metal spring, and can be fitted to the inner housing 4 or the outer housing 2.

The press-on elements 8 can be deflected elastically transversely to the assembly direction M and serve to compensate a tolerance between the inner housing 4 and the outer housing 2 transversely to the assembly direction M, coupling the inner housing 4 and the outer housing 2 to one another by a press-fit connection.

Each elastic press-on element 8 has a bracket 12, shown in FIG. 1, which extends outwardly from the lateral surface 7 transversely to the assembly direction M. At an end 14 of the bracket 12 facing away from the lateral surface 7 there is arranged a spring tab 16, which extends substantially by 90° away from the bracket 12 along the assembly direction M. The spring tab 16 ends in front of an offset 17 of an end surface 18 of the inner housing 4. The end surface 18 faces the outer housing 2 in the assembly direction M. A recess 19 is produced between the spring tab 16 and the lateral surface 7, and the press-on element 8 has a substantially L-shaped cross-section. In an embodiment, the spring tab 16 can extend from one bracket 12 to a second bracket 12, such that the press-on element 8 has a substantially U-shaped cross-section.

The spring tab 16, as shown in FIG. 1, has a contact-pressure surface 20 extending transversely to the longitudinal axis L away from the inner housing 4. In the mounted state, the contact-pressure surface 20 presses against a support surface 22 of the outer housing 2, in order to produce a press-fit connection between the inner housing 4 and the outer housing 2. During the mounting, a normal force acts upon the contact-pressure surface 20 and the spring tab 16 is deflected transversely to the assembly direction M in the direction of the inner housing 4. The contact-pressure surface 20 tapers in the direction of the support surface 22, and thus has a chamfer 23 at the edge. The chamfer 23 runs along the longitudinal axis L and facilitates the plugging-in in the assembly direction M, as a small resistance must be overcome in comparison with a stepped configuration.

As shown in FIG. 1, the outer housing 2 has a receptacle 24 into which the inner housing 4 can be inserted. The receptacle 24 is bounded transversely to the assembly direction M by a plurality of lateral walls 26 and has a substantially rectangular cross-section complementary to the inner housing 4. The support surface 22 of the outer housing 2 is formed by a prominent portion 28 protruding in the direction of the inner housing 4. In an embodiment, the outer housing 2 is water-tight and surrounds the inner housing 4 in a protective manner after mounting.

As shown in FIG. 1, the inner housing 4 has an internal width 30 transverse to the assembly direction M between two contact-pressure surfaces 20 arranged on opposite lateral surfaces 7 in relation to the inner housing 4. The internal width 30 of the inner housing 4 is greater than an internal width 32 between the opposite support surfaces 22 of the outer housing 2. An internal width 33 of the inner housing 4 without contact-pressure surfaces 20 is smaller than the internal width 32, as a result of which a gap 34 would arise between inner housing 4 and outer housing 2 during plugging-together without press-on elements 8. By way of the press-on element 8, when the plugging-together is carried out, the gap 34 is closed by the contact-pressure surface 20 and the support surface 22 is contacted. As a result, the inner housing 4 can be fixed in a play-free manner in the outer housing 2.

During the mounting, each press-on element 8 is deflected elastically transversely to the assembly direction M in the direction of the inner housing 4. The press-on element 8 presses with its contact-pressure surface 20 against the corresponding support surface 22 and produces a press-fit connection between the outer housing 2 and the inner housing 4 by the elastic force. In the mounted state, the internal width 30 of the inner housing 4 corresponds substantially to the internal width 32 of the outer housing 2. A tolerance is compensated by the elastic press-on elements 8. High plugging forces during mounting, due to an over-pressing, are reduced by the elastic press-on elements 8; the elastic press-on elements 8 are deflected in the direction of the lateral surface 7 of the inner housing 4 by the over-dimension between the internal width 30 and the internal width 32, and thus prevent an over-pressing. In order to produce a stable press-fit connection, the material thickness of the contact-pressure surface 20 transverse to the assembly direction M is greater than the width of the gap 34 transverse to the assembly direction M.

In the embodiment of FIG. 1, a press-on element 8 is molded on each lateral surface 7 of the inner housing 4. As a result, a secure and tilt-free fixing of the inner housing 4 in the outer housing 2 can be ensured. Depending on spatial conditions and dimensions of the electric plug 1, in various embodiments, at least one press-on element 8 can be arranged on a lateral surface 7, at least two press-on elements 8 can be arranged on two mutually adjacent lateral surfaces 7 or two mutually opposite lateral surfaces 7 with respect to the inner housing 4, or at least three press-on elements 8 can be arranged on three lateral surfaces 7. The press-on elements 8 can be arranged on the outer housing 2 and the inner housing 4 has the complementary support surfaces 22. In another embodiment, several mutually spaced-apart press-on elements 8 can be arranged on a lateral surface 7 along the longitudinal axis L. In an embodiment, all lateral surfaces 7 have at least two press-on elements 8, one press-on element 8 in each case being arranged at an end of the lateral surface 7 lying along the longitudinal axis L. As a result, tilting of the inner housing 4 is prevented.

Figure 3:
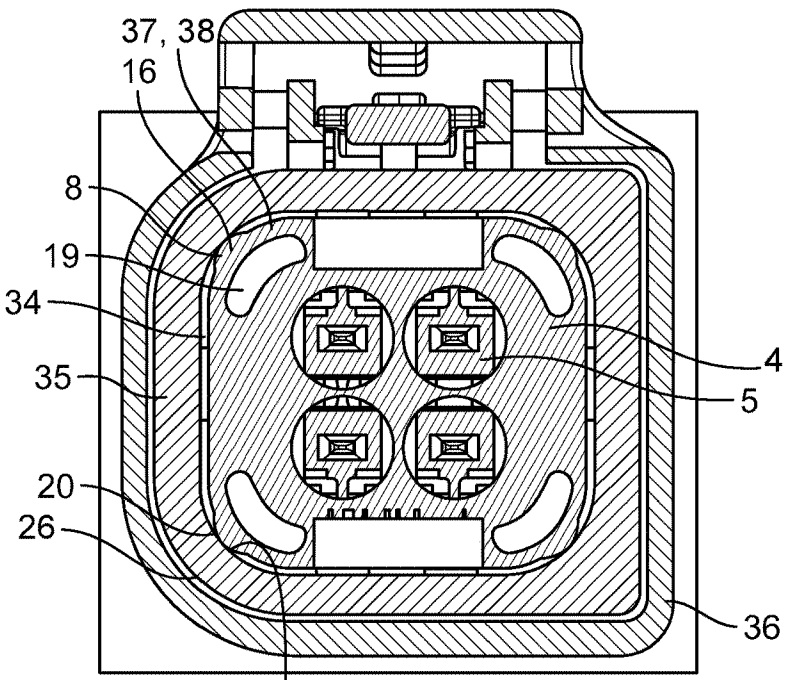
FIG. 3 is a sectional top view of the electric plug taken along line 3-3 of FIG. 2.
Figure 2:
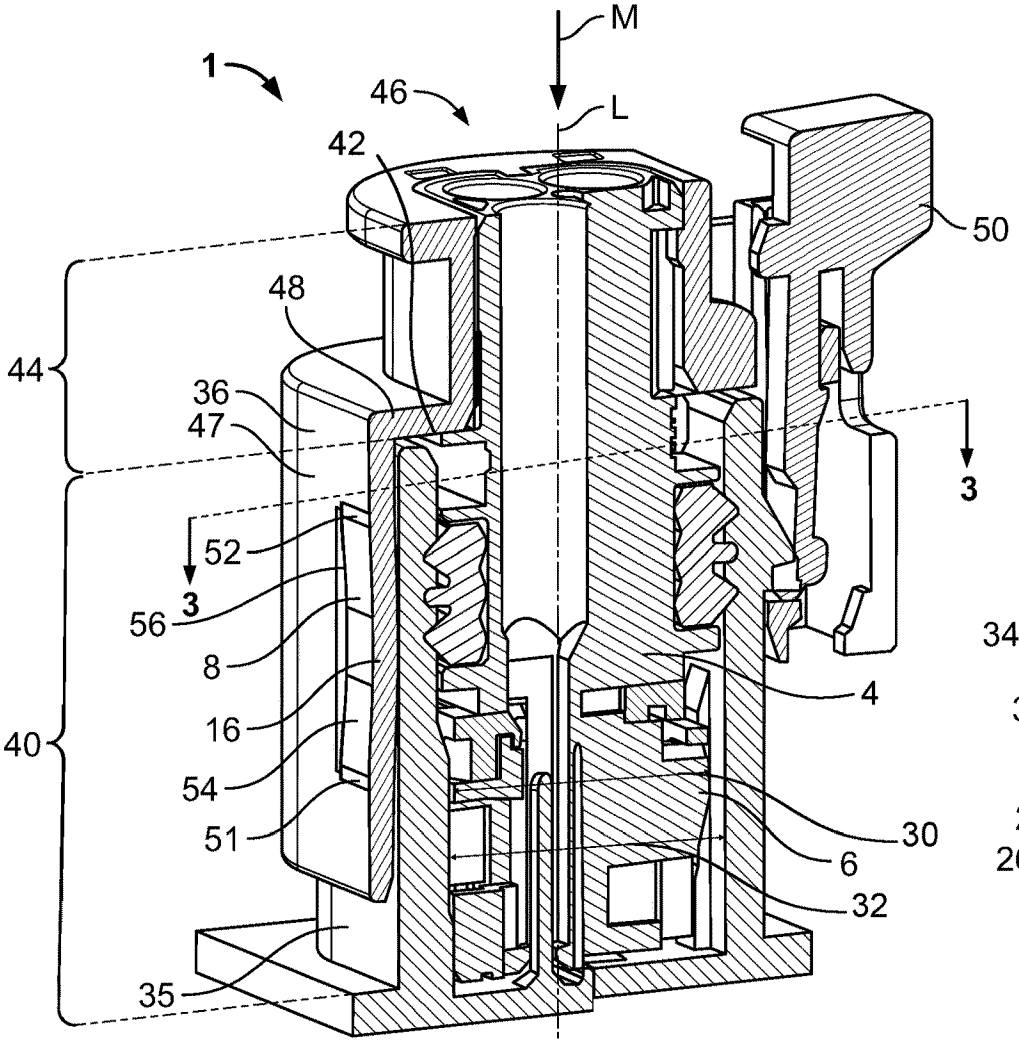
FIG. 2 is a sectional perspective view of an electric plug according to another embodiment in a mounted state.

An electric plug 1 according to another embodiment is shown in FIGS. 2 and 3. In the embodiment shown in FIGS. 2 and 3, the outer housing 2 is constructed from two separate housing parts 35, 36. A rear housing part 35 in the assembly direction M is partly surrounded by a front housing part 36 in the assembly direction M, and is connected to the front housing part 36 in a play-free manner by a press-fit connection produced by a press-on element 8.

As shown in FIGS. 2 and 3, the inner housing 4 is inserted into the rear housing part 35 in the assembly direction M and is fixed by the press-fit connection produced by at least one press-on element 8. The press-on element 8 with a spring tab 16 extends across a rounded corner 38 between two adjacent lateral surfaces 7 which are arranged at substantially 90° to one another. The press-on element 8 is by a collar 37, which is provided with a recess 19 extending across the corner 38. At each corner 38, a spring tab 16 is arranged between the support surface 22 at the lateral wall 26 of the rear housing part 35 and the recess 19. The spring tabs 16 each have a contact-pressure surface 20 protruding in the direction of the support surface 22. The contact-pressure surface 20 has the shape of a segment of a sphere, the apex being directed towards the support surface 22. The contact-pressure surface 20 is complementary to the support surface 22, which is formed by the rounded corner between the mutually adjacent lateral walls 26.

As shown in FIG. 3, a gap 34 extends between the inner housing 4 and the rear housing part 35. The contact-pressure surface 20 projects into this gap 34 and is supported on the support surface 22 of the rear housing part 35, fixing the inner housing 4 in the rear housing part 35 in a play-free manner with the press-fit connection. The spring tab 16 can be deflected in the direction of the recess 19, in order to avoid high plugging forces during plugging of the inner housing 4 into the rear housing part 35.

The inner housing 4, as shown in FIGS. 2 and 3, has an elongated base body 6 along the assembly direction M and four contact receptacles 5 along the longitudinal axis L. The contact receptacles 5 are arranged in a square and each receive a contact of a complementary mating plug. The base body 6 has a rear section 40 enclosed by the rear housing part 35 in the assembly direction M. The rear section 40 has an internal width 30 transverse to the assembly direction M, the internal width 30 is approximately as large as the internal width 32 of the receptacle of the rear housing part 35, in order to ensure play-free fixing of the inner housing 4 and of the rear housing part 35.

The rear section 40, as shown in FIGS. 2 and 3, has a plurality of elastic press-on elements 8 on the lateral surfaces 7, on the front and rear ends in the assembly direction M. As a result, tilting of the inner housing 4 in the rear housing part 35 is prevented.

The base body 6 narrows uniformly with a step 42 shown in FIG. 2 which runs around the base body 6 transversely to the assembly direction M. The narrowed section 44 extends from the step 42 counter to the assembly direction M and forms the front end of the elongate base body 6 in the assembly direction M.

As shown in FIGS. 2 and 3, the rear section 40 is surrounded by the rear housing part 35. The front housing part 36 extends along the longitudinal axis L and is plugged onto the inner housing 4 in the assembly direction M. For this purpose, the front housing part 36 has an opening 46 along the longitudinal axis L. The opening 46 is bounded by a wall 47 transversely to the assembly direction M and has a substantially rectangular cross-section transverse to the assembly direction M. The opening 46 has a contour which is complementary to the narrowed section 44. In an embodiment, additional elastic press-on elements 8 can be arranged on the narrowed section 44, in order to produce a play-free and tilt-free fixing of the inner housing 4 in the front housing part 36. The front housing part 36 extends along the longitudinal axis L in the assembly direction M as far as the limit stop on the step 42.

At the limit stop on the step 42, the front housing part 36 has a shoulder 48, shown in FIG. 2, with which the opening 46 is widened, and extends further in the assembly direction M. The front housing part 36 surrounds the rear housing part 35. The front housing part 36 has a housing interlock 50 on one side transversely to the assembly direction M. The housing interlock 50 has a latching arm which can be latched on a latching nose of the rear housing part 35; the latching nose stands proud of the lateral wall 7 transversely to the assembly direction M. As a result, inadvertent opening during operation and the inner housing 4 slipping out counter to the assembly direction M is prevented.

The front housing part 36 has an elastic press-on element 8 on at least one side of the opening 46 transversely to the assembly direction M, the elastic press-on element 8 is molded from the wall 47 of the front housing part 36. The elastic press-on element 8 has a spring tab 16, which extends along the longitudinal axis L and protrudes in the direction of the lateral wall 26 of the rear housing part 35 transversely to the assembly direction M and is pressed against an outer surface of the lateral wall 26 of the rear housing part 35, the outer surface is directed towards the wall 47 of the front housing part 36. In this embodiment, a material thickness of the spring tab 16 corresponds to the material thickness of the wall 47. As a result, the front housing part 36 is connected to the rear housing part 35 by a press-fit connection produced by the elastic press-on element 8.

The spring tab 16 is molded by a cutout of the wall 47, and as shown in FIG. 2, the cutout extends along the longitudinal axis L and is connected to the wall 47 at both ends 51, 52 of the cutout lying along the longitudinal axis L. The spring tab 16 has the contact-pressure surface 20 which extends substantially parallel to the longitudinal axis L, and two spring arms 54, 56 which extend in each case from one end 51, 52 to the contact-pressure surface 20, at an angle which is inclined with respect to the rear housing part 35 along the longitudinal axis L. The elasticity of the press-on element 8 transverse to the assembly direction M is ensured by the spring arms 54, 56.

With the elastic press-on element 8, a tolerance between the elements to be plugged in and the receiving elements can be overcome. A tolerance can lead to an overpressing and play between the elements, as a result of which these elements can be damaged by movement and vibrations. With the elastic press-on elements 8, when there is an overpressing, the press-on element 8 is deflected in the direction of the normal force acting upon the press-on element 8 during plugging-in, and the high plugging forces owing to the overpressing are reduced. Furthermore, the play in the plugged state is minimized or set to zero by the press-on elements 8, which produce a press-fit connection between the inner housing 4 and the outer housing 2 or between the front housing part 36 and the rear housing part 35 of the outer housing 2. The dismounting and maintenance of the electric plug 1 is simplified by the press-fit connection, as only a low tensile force is required in order to remove the inner housing 4 from the outer housing 2, for example. Due to the elasticity of the press-on elements 8, vibrations occurring can be absorbed dynamically by the press-on elements 8 and movement of the inner housing 4 relative to the outer housing 2 is restricted. Thus, the wear on the electric plug 1 is reduced and the service life is lengthened.

Figure 4:
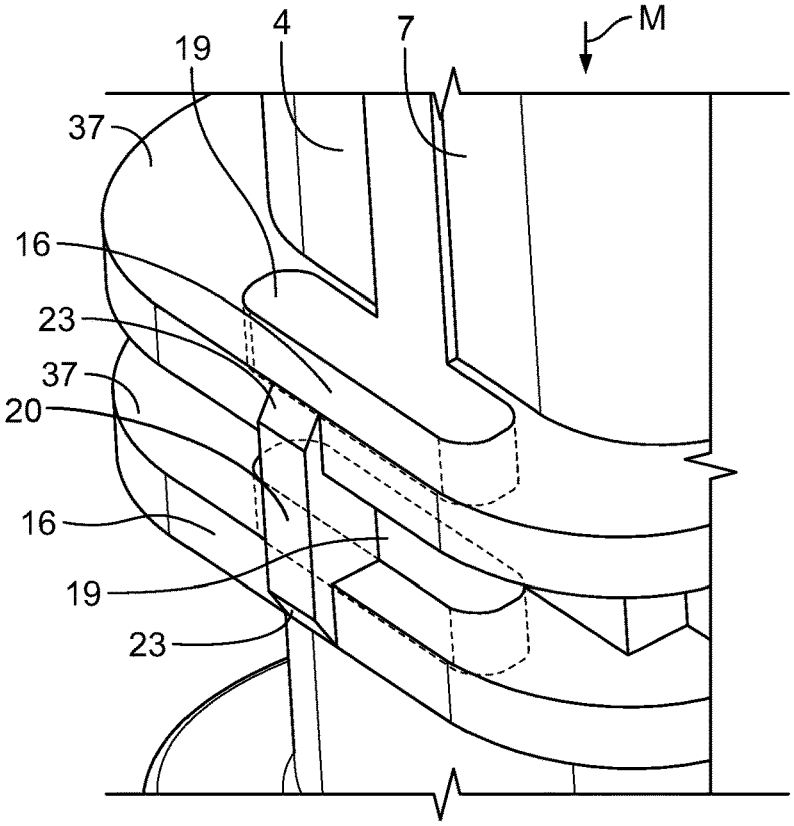
FIG. 4 is a perspective view of an elastic press-on element of an electric plug according to another embodiment.

A press-on element 8 according to another embodiment for a plug 1 is shown in FIG. 4. The press-on element 8 of FIG. 4 is molded by a pair of collars 37 which run around the inner housing 4, project transversely to the assembly direction M, and are spaced apart from one another in the assembly direction M. The collars 37 are arranged parallel to one another and are punctuated by a recess 19 on at least one lateral surface 7 of the inner housing 4 in the assembly direction M. The recess 19 extends transversely to the assembly direction M parallel to the lateral surface 7. Each collar 37 has a spring tab 16 between the recess 19 and the end of the collar 37 facing away from the lateral surface 7 of the inner housing 4. The spring tab 16 extends transversely to the assembly direction M parallel to the lateral surface 7. Thus, the press-on element 8 has a substantially U-shaped cross-section transverse to the assembly direction M.

The spring tabs 16, as shown in FIG. 4, have a contact-pressure surface 20 which projects away in the assembly direction M and connects the two spring tabs 16 to one another in the direction of the lateral surface 7. The contact-pressure surface 20 extends between the surfaces of the spring tabs 16 facing one another and on the surface of the spring tabs 16 facing away from the lateral surface 7. The contact-pressure surface 20 terminates, in the assembly direction M and counter to the assembly direction M, in a chamfer 23 running towards the surface of the spring tab 16 facing away from the lateral surface 7, in order to facilitate a plugging-in and unplugging.

Figure 5:
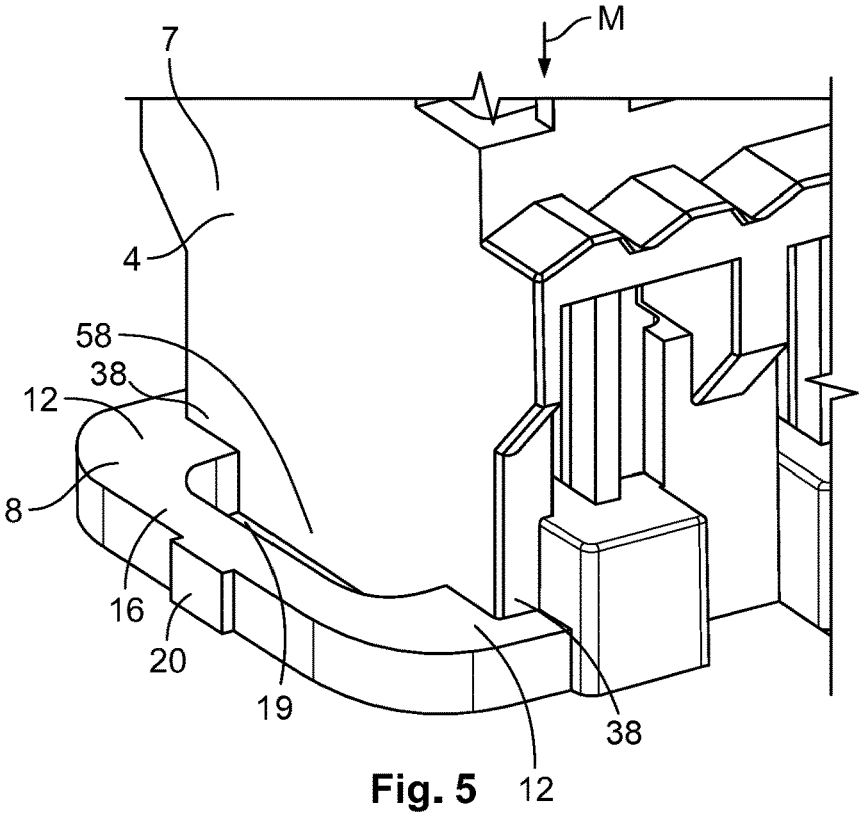
FIG. 5 is a perspective view of another elastic press-on element of an electric plug according to another embodiment.

A press-on element 8 according to another embodiment for a plug 1 is shown in FIG. 5. The press-on element 8 is arranged on an inner housing 4 on a lateral surface 7 at an end 58 lying to a rear in the assembly direction M. The press-on element 8 has a pair of brackets 12 arranged parallel to one another, which project from the lateral surface 7 of the inner housing 4 at opposite corners 38 of the lateral surface 7 transversely to the assembly direction M. The brackets 12 are connected to one another by a spring tab 16, which extends transversely to the assembly direction M. The spring tab 16 is spaced apart from the lateral surface 7 transversely to the assembly direction M by a recess 19, which extends between the brackets 12 and between lateral surface 7 and spring tab 16.

The press-on element 8 shown in FIG. 5 has a substantially U-shaped cross-section transverse to the assembly direction M. The spring tab 16 can be deflected in the direction of the receptacle when there is an application of force, preventing a high plugging force. The spring tab 16 has a contact-pressure surface 20 protruding in the direction away from the lateral surface 7. The inner housing 4 is supported with the contact-pressure surface 20 on the outer housing 2 when the plug 1 is plugged-together. Depending on dimension and spatial conditions of the plug 1, differently configured press-on elements 8 can be arranged on the inner housing 4 and/or on the outer housing 2.

What is claimed is:

1. An electric plug, comprising:

an outer housing;

an inner housing adapted to be plugged into the outer housing along an assembly direction; and a press-on element including a bracket projecting from the outer housing to the inner housing or from the inner housing to the outer housing, the bracket comprising:

a first projection;

a second projection; and a tab extending between the first projection and the second projection, the first and second projections and the tab defining a recess formed between the press-on element and the inner housing or the outer housing, the tab of the press-on element adapted to be deflected elastically transversely to the assembly direction and in a direction of the recess from a first resting position into a second deflected position as the inner housing is plugged into the outer housing, the press-on element remaining in the second deflected position when the inner housing is in a mounted state within the outer housing and producing a press-fit connection between the inner housing and the outer housing in the mounted state.

2. The electric plug of claim 1, wherein the press-on element is disposed between the outer housing and the inner housing and secures the inner housing within the outer housing in the mounted state with substantially only a friction force generated between the press-on element and a surface of the outer housing or the inner housing.

3. The electric plug of claim 1, wherein the press-on element and the inner housing and/or the outer housing comprise no opposing surfaces in a direction of disassembly when the inner housing is in the mounted state within the outer housing.

4. The electric plug of claim 1, wherein the press-on element extends transversely to the assembly direction across a gap between the inner housing and the outer housing.

5. The electric plug of claim 1, wherein the inner housing or the outer housing is formed integrally as a monolithic component with the press-on element.

6. The electric plug of claim 1, wherein a pair of press-on elements are arranged on a pair of mutually adjacent lateral surfaces between the inner housing and the outer housing.

7. The electric plug of claim 1, wherein a pair of press-on elements are arranged on a pair of mutually opposite lateral surfaces between the inner housing and the outer housing.

8. The electric plug of claim 1, wherein the press-on element extends across a corner between a pair of adjacent lateral surfaces of the inner housing.

9. The electric plug of claim 1, wherein the press-on element has a projecting contact-pressure surface.

10. The electric plug of claim 9, wherein the contact-pressure surface engages a support surface of the outer housing or the inner housing in the mounted state of the inner housing and the outer housing.

11. The electric plug of claim 10, wherein the contact-pressure surface is complementary to the support surface.

12. The electric plug of claim 1, wherein the press-on element has a substantially U-shaped cross-section in the assembly direction.

13. The electric plug of claim 1, wherein the press-on element is molded on a wall of the outer housing or the inner housing.

14. The electric plug of claim 1, wherein the second deflected position corresponds to a position of maximum deflection of the press-on element as the inner housing is plugged into the outer housing.

15. An inner housing, comprising:

a base body extending along a longitudinal axis and configured to be inserted into an outer housing in an assembly direction; and a press-on element including a bracket projecting from the inner housing, the bracket comprising:

a first projection;

a second projection; and a tab extending between the first projection and the second projection, the first and second projections and the tab defining a recess formed between the press-on element and the inner housing, the tab of the press-on element adapted to be deflected transversely to the assembly direction and in a direction of the recess from a first resting position into a second deflected position as the inner housing is inserted into the outer housing, the press-on element remaining in the second deflected position when the inner housing is in a mounted state within the outer housing and producing a press-fit connection between the inner housing and the outer housing in the mounted state.

16. The inner housing of claim 15, wherein the press-on element defines a curved contact-pressure surface having an apex configured to engage with a surface of the outer housing when the inner housing is received within the outer housing.

17. The inner housing of claim 15, wherein the bracket defines a portion of:

a first collar formed about a wall of the body and extending in a direction transversely to the assembly direction, the press-on element further including:

a second collar formed about the wall of the body and extending in a direction transversely to the assembly direction; and a contact-pressure projection defining a contact surface extending between the first collar and the second collar.

18. An outer housing, comprising:

a receptacle adapted to receive an inner housing; and a press-on element arranged in the receptacle and including a bracket projecting from the outer housing into the receptacle, the bracket comprising:

a first projection;

a second projection; and a tab extending between the first projection and the second projection, the first and second projections and the tab defining a recess formed between the press-on element and the outer housing, the tab of the press-on element adapted to be deflected by the inner housing in a direction of the outer housing and in a direction of the recess from a first resting position into a second deflected position as the inner housing is received into the outer housing, the press-on element remaining in the second deflected position when the inner housing is in a mounted state within the outer housing and producing a press-fit connection between the inner housing and the outer housing in the mounted state.

* * * * *